US006220838B1

(12) United States Patent
Osborne

(10) Patent No.: US 6,220,838 B1
(45) Date of Patent: Apr. 24, 2001

(54) PROGRESSIVE CAVITY PUMP WITH MELTABLE STATOR

(75) Inventor: Alfred M. Osborne, Bluffdale, UT (US)

(73) Assignee: Dyno Nobel Inc., Salt Lake City, UT (US)

( * ) Notice: Subject to any disclaimer, the term of this patent is extended or adjusted under 35 U.S.C. 154(b) by 0 days.

(21) Appl. No.: 09/432,208

(22) Filed: Nov. 3, 1999

(51) Int. Cl.[7] ..... F04C 2/107; F04C 5/00; F04C 13/00

(52) U.S. Cl. ..... 418/1; 418/48; 418/153

(58) Field of Search ..... 418/1, 48, 153; 86/31, 33

(56) References Cited

U.S. PATENT DOCUMENTS

| | | | |
|---|---|---|---|
| 1,426,206 | 8/1922 | Lybeck | 417/32 |
| 2,512,765 | 6/1950 | Byram | 417/44.1 |
| 2,778,313 | 1/1957 | Hill | 417/32 |
| 3,008,426 | 11/1961 | Edwards et al. | 418/69 |
| 3,111,904 | 11/1963 | Burns | 415/123 |
| 4,500,268 | 2/1985 | Sundberg et al. | 418/69 |
| 5,318,416 * | 6/1994 | Hantschk et al. | 418/48 |
| 5,603,608 * | 2/1997 | Marz | 418/48 |
| 5,779,460 * | 7/1998 | Marz | 418/48 |

FOREIGN PATENT DOCUMENTS

| | | |
|---|---|---|
| 0 255 336 | 2/1988 | (EP) . |

* cited by examiner

*Primary Examiner*—John J. Vrablik

(57) ABSTRACT

The invention comprises a progressive cavity pump for pumping a flowable explosive composition or other heat-sensitive material comprising an inlet and an outlet; a stator that is meltable at or above a selected maximum pump operation temperature; a rotor, and a drive shaft connecting the rotor to a power source; wherein the stator will melt above the selected temperature to prevent the generation of temperatures within the pump high enough to create a hazard. The invention also relates to a method of safely pumping a flowable explosive composition or other heat-sensitive material comprising the use of a progressive cavity pump having a stator that is meltable above a selected maximum pump operation temperature for the similar result.

23 Claims, 2 Drawing Sheets

PROGRESSIVE CAVITY PUMP WITH MELTABLE STATOR

The present invention relates to a novel pump for pumping a flowable explosive composition or other heat sensitive material, and more particularly to a progressive cavity pump for such purpose. The present invention also relates to a novel method for safely pumping a flowable explosive composition or other heat sensitive material.

A progressive cavity pump is well understood to mean a rotary positive displacement pump in which a helical rotor shaft is rotated within a fixed stator. The stator is composed of a resilient material and has an actual longitudinal cavity defining a helical groove. When rotated within the stator cavity, the rotor makes contact with the stator to form a series of cavities which move in an axial direction thereby forcing the pumped medium progressively along the axis to the pump outlet. In the present invention a meltable stator is provided that will begin to melt at a predetermined, elevated temperature, so that pressure and frictional heating within the pump will be reduced or relieved so as to prevent adverse or unsafe high temperature degradations or reactions of the pumped explosive composition or other heat sensitive material.

BACKGROUND OF THE INVENTION

Because explosive compositions are sensitive to heat, pressure, friction and shock, the pumping of such compositions should be done in a manner to eliminate the presence or creation of hazardous conditions caused by exceeding safe limits for these variables. For example, in a progressive cavity pump, internal friction exists between the rotor and stator, and this friction continually generates heat during the pumping operation. The amount of heat generated normally is small enough that it simply can be transferred to and dissipated within the composition being pumped, without heating the composition to an undesirable temperature. When little or no flow exists in the pump because of a closed or restricted outlet or lack of composition flow to the inlet, however, the frictional heat can accumulate in the rotor and stator themselves, which after a period of time, can become hot enough and can transfer enough heat to the composition to cause its ignition.

Some approaches have been used or suggested for addressing this explosive composition pumping problem. Safety shutdown systems are utilized that monitor electronically the temperature and pressure parameters at various locations in or proximate to the pump, so that if the conditions exceed set maximum limits the systems will automatically shut down the pump's operation. This or similar monitoring observations have been done manually, with a pump operator present to observe the live operations of the pump. Both of these approaches are potentially deficient in that they are susceptible to mechanical (or electronic) or human error, and if error occurs, the pump may continue to operate and create the overheating phenomenon described above.

European Patent Application (EPA) publication No. 0 255 336 discloses another approach for eliminating or reducing the possibility of overheating occurring in a progressive cavity pump. Disclosed is a connection between the drive shaft of the pump and the rotor that comprises a heat-sensitive, breakaway bond of a heat-fusable metal alloy, the metal alloy connection being meltable upon the generation of heat within the pump cavity so as to disconnect the mechanical linkage between the drive shaft and the rotor.

This approach has the disadvantages of being relatively expensive to build and to replace (following an event of overheating and disconnection) when compared to the meltable stator of the present invention. Further, internal friction and heat generation will continue to occur between the drive shaft and the metal alloy. A number of earlier U.S. patents are cited and described in this EPA publication that address different approaches for sensing the operating conditions of rotary pumps.

In spite of these prior approaches, a need exists for a reliable, simple, fail-safe and economic means for preventing the overheating of a progressive cavity pump that is pumping explosive compositions or other heat-sensitive materials.

The present invention satisfies this need by providing a meltable, elastomeric stator that has a melting temperature at a predetermined level above the normal or desired operating temperature of the pump but below the thermal reaction temperature of the explosive composition or heat-sensitive material being pumped. This melting of the stator causes the accumulation of heat to cease so that the temperature within the pump decreases and becomes essentially constant at a temperature below the thermal reaction temperature of the explosive composition or other material. In this way, the temperature of the pump simply cannot increase above the undesired thermal reaction temperature, because the melting stator no longer provides any resistance and thus friction to the rotating rotor. The melting occurs naturally and simply as the result of the temperature increase in the pump, and thus is not dependent upon external controls or monitors. It has an additional advantage over the approach disclosed in EPA 0 255 336 in that the stator melts in direct response to the operating temperature within the pump cavity and thus within the explosive composition being pumped, rather than first requiring the conduction of heat through the rotor to the connection between the rotor and the drive shaft. This conduction process takes time and could result in the composition reaching an undesired temperature before the connection breaks away. Another advantage of the meltable stator is that it easily and inexpensively can be retrofitted to existing pumps that are used for pumping heat-sensitive materials.

Thus the present invention provides an important safety enhancement to progressive cavity pumps that are used to pump explosive compositions and other heat-sensitive materials.

SUMMARY OF THE INVENTION

The invention comprises a progressive cavity pump for pumping a flowable explosive composition or other heat-sensitive material comprising an inlet and an outlet; a stator that is meltable at or above a selected maximum pump operation temperature; a rotor, and a drive shaft connecting the rotor to a power source; wherein the stator will melt above the selected temperature to prevent the generation of temperatures within the pump high enough to create a hazard. The invention also relates to a method of safely pumping a flowable explosive composition or other heat-sensitive material comprising the use of a progressive cavity pump having a stator that is meltable above a selected maximum pump operation temperature for the similar result.

DETAILED DESCRIPTION

Figure 1:
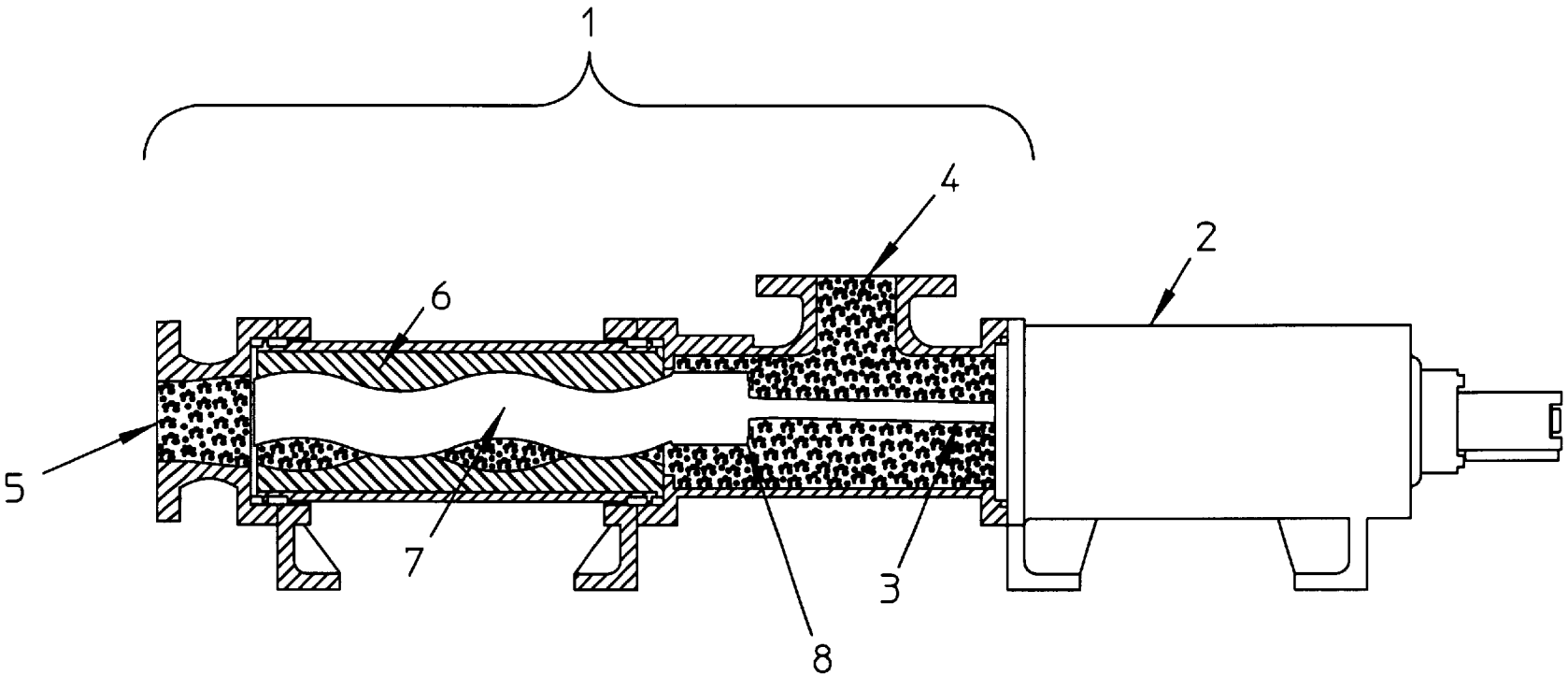
FIG. 1 is a longitudinal cross-sectional view of a typical progressive cavity pump.

Referring to FIG. 1, shown is a longitudinal cross-sectional view of a typical progressive cavity pump, generally indicated at 1. Pump 1 has a drive shaft support casing 2, a drive shaft 3 that is connected to a power source (not shown), an inlet 4, an outlet 5, a stator 6 and a rotor 7. In the embodiment shown, the drive shaft 3 is flexible and rotationally gyrates due to both the rotational force supplied by the power source and the eccentric shape of the rotor 7 to which the drive shaft 3 is connected at position 8. Preferably, the flexible drive shaft 3 is coupled directly to the drive shaft of a hydraulic motor power source (not shown). This eliminates the need for pump drive mechanism bearings that could be another potential source of heat if the bearings fail. In this way the hydraulic motor bearings are used as the bearings of the pump 1, and since these bearings are cooled continually by the flow of hydraulic oil passing through the motor, the bearings do not become a potential heat source.

In operation, the rotation of flexible shaft 3 in turn rotates the rotor 7 thereby forcing the pumped medium (that enters at inlet 4) through cavities defined by the rotor 7 and stator 6 assembly and then out outlet 5.

For purposes of the present invention, the key and novel component of pump 1 is the stator 6. The stator 6 is resilient and preferably comprises a thermal plastic elastomer, that preferably is selected from the group consisting of urethanes, thermal plastic rubbers and thermal plastic polyolefins. A preferred urethane is a polyester-polyether blend available from Anderson Development Company, Adrian, MI, as Andur 700-AP, and as further described in U.S. Pat. No. 4,182,898. A preferred polyolefin is polyethylene. For pumping most explosive compositions, the maximum pump operation temperature for safety reasons is from about 140° C. to about 150° C. Correspondingly, the stator has a melting temperature of from about 140° C. to about 150° C. If for any reason the pump operation temperature elevates beyond this range, the stator would begin to melt and thereby prevent the operation temperature from increasing further. (In fact, the temperature normally would begin to drop.) If the thermal reaction temperature of the explosive composition or heat-sensitive material being pumped is above this melting or pump operation temperature, then the explosive composition or material will not reach a high enough temperature to thermally react so as to create a safety hazard. Preferably, the selected maximum pump operation temperature is at least 10° C. above the crystallization or solidification temperature of the explosive composition being pumped, and more preferably is at least 20° C. higher. The following example further illustrates the present invention.

Figure 2:
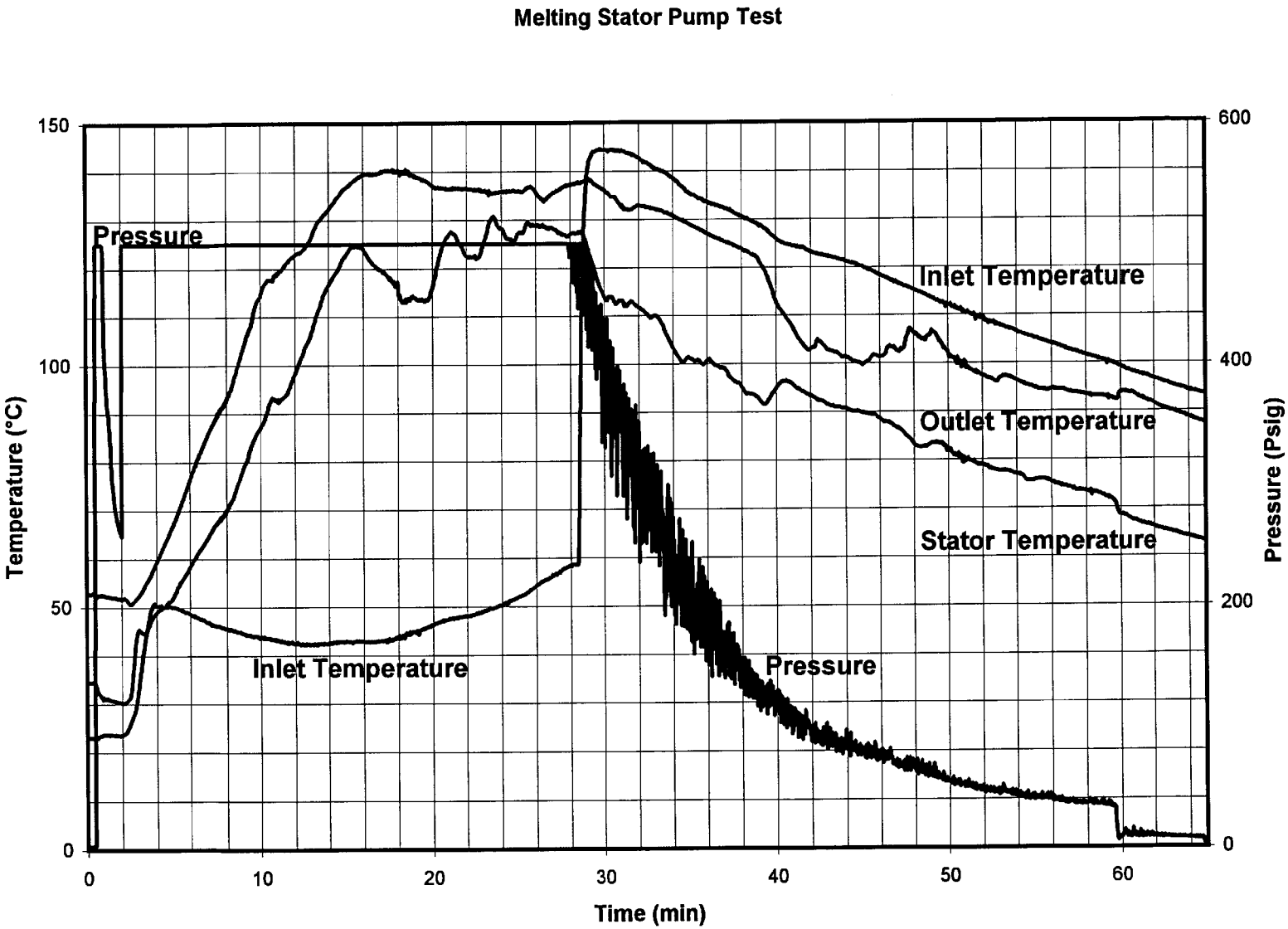
FIG. 2 is a graphical illustration of testing conducted on a progressive cavity pump of the present invention.

A progressive cavity pump intentionally was operated in a manner to deadhead while pumping a water-in-oil emulsion explosive composition. Initially, the pump was filled with warm emulsion explosive and operated slowly with the outlet open. After a few minutes, the pump was caused to deadhead, creating a pressure of over 500 psi and a temperature reaching 140° C. At or near 140° C., the thermoplastic elastomer (urethane) stator (Andur 700-AP) commenced melting, thereby relieving the pressure, and after 1 hour, the internal temperature of the pump had decreased from 140° C. to 80° C. and the pressure had decreased from over 500 psi to 40 psi. No burning or scorching occurred to the continuous oil (fuel) phase of the emulsion, and no decomposition occurred to the internal droplets of oxidizer solution. This testing is illustrated graphically in FIG. 2.

Whereas this invention is illustrated and described with reference to embodiments presently contemplated as the best mode or modes of carrying out such invention in actual practice, it is to be understood that various changes may be made in adapting the invention to different embodiments without departing from the broader inventive concepts disclosed herein and comprehended by the claims that follow.

What is claimed is:

1. A progressive cavity pump for pumping a flowable explosive composition or other heat sensitive material comprising:

(a) an inlet and an outlet;

(b) a stator that is meltable at or above a selected maximum pump operation temperature;

(c) a rotor, and (d) a drive shaft connecting the rotor to a power source; wherein the stator will melt above the selected temperature to prevent the generation of temperatures within the pump high enough to create an explosion hazard.

2. A progressive cavity pump according to claim 1 wherein the stator is a thermoplastic elastomer.

3. A progressive cavity pump according to claim 2 wherein the thermoplastic elastomer is selected from the group consisting of urethanes, thermoplastic rubbers and thermoplastic polyolefins.

4. A progressive cavity pump according to claim 3 wherein the urethane is a polyester-polyether blend.

5. A progressive cavity pump according to claim 3 wherein the thermoplastic polyolefin is polyethylene.

6. A progressive cavity pump according to claim 1 wherein the drive shaft is flexible and is directly coupled to a drive shaft of a hydraulic motor power source.

7. A progressive cavity pump for pumping an explosive composition according to claim 1 wherein the selected maximum pump operation temperature is from about 140° C. to about 150° C.

8. A progressive cavity pump according to claim 7 wherein the stator is a thermoplastic elastomer having a melting temperature of from about 140° C. to about 150° C.

9. A progressive cavity pump according to claim 8 wherein the thermoplastic elastomer is selected from the group consisting of urethanes, thermoplastic rubbers and thermoplastic polyolefins.

10. A progressive cavity pump according to claim 8 wherein the urethane is a polyester-polyether blend.

11. A progressive cavity pump according to claim 8 wherein the thermoplastic polyolefin is polyethylene.

12. A method of safely pumping a flowable explosive composition or other heat sensitive material comprising the use of a progressive cavity pump having a stator that is meltable above a selected maximum pump operation temperature such that the stator will melt if the pump operation temperature exceeds the selected temperature to prevent the generation of temperatures within the pump high enough to create an explosion hazard.

13. A method according to claim 12 wherein the stator is a thermoplastic elastomer.

14. A method according to claim 12 wherein the thermoplastic elastomer is selected from the group consisting of urethanes, thermoplastic rubbers and thermoplastic polyolefins.

15. A method according to claim 12 wherein the urethane is a polyester-polyether blend.

16. A method according to claim 12 wherein the thermoplastic polyolefin is polyethylene.

17. A method according to claim 12 wherein the pump has a drive shaft that is flexible and is directly coupled to a drive shaft of a hydraulic motor power source.

18. A method of pumping a flowable explosive composition according to claim 12 wherein the selected maximum pump operation temperature is from about 140° C. to about 150° C.

19. A method of pumping a flowable explosive composition according to claim 18 wherein the stator is a thermoplastic elastomer having a melting temperature of from about 140° C. to about 150° C.

20. A method according to claim 18 wherein the thermoplastic elastomer is selected from the group consisting of urethanes, thermoplastic rubbers and thermoplastic polyolefins.

21. A method of safely pumping a flowable explosive composition according to claim 12 wherein the selected maximum pump operation temperature is at least 10° C. above the crystallization or solidification temperature of the explosive composition.

22. A method according to claim 21 wherein the selected maximum pump operation temperature is at least 20° C. above the crystallization or solidification temperature of the explosive composition.

23. A method of safely pumping a flowable heat sensitive material according to claim 21 wherein the selected maximum pump operation temperature is above the normal operation temperature for pumping such material.

* * * * *